US011795948B2

(12) United States Patent
Goy et al.

(10) Patent No.: US 11,795,948 B2
(45) Date of Patent: Oct. 24, 2023

(54) STACKED GEROTOR PUMP PRESSURE PULSATION REDUCTION

(71) Applicant: Hamilton Sundstrand Corporation, Charlotte, NC (US)

(72) Inventors: Edward W. Goy, Crystal Lake, IL (US); Zachary Allen Ray Le Duc, Rockford, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 17/581,424

(22) Filed: Jan. 21, 2022

(65) Prior Publication Data

US 2023/0235737 A1 Jul. 27, 2023

(51) Int. Cl.
*F04C 23/00* (2006.01)
*F04C 18/10* (2006.01)

(52) U.S. Cl.
CPC ..... *F04C 23/001* (2013.01); *F04C 18/10* (2013.01); *F04C 2240/20* (2013.01)

(58) Field of Classification Search
CPC ..... F04C 23/001; F04C 18/10; F04C 2240/20
See application file for complete search history.

(56) References Cited

U.S. PATENT DOCUMENTS 4,519,755 A * 5/1985 Hanson ..... F04C 23/001 418/9
5,630,318 A 5/1997 Folsom et al.
6,238,315 B1 5/2001 Morse et al.
6,386,836 B1 * 5/2002 Johnson ..... F04C 11/001 417/310
6,666,015 B2 12/2003 Dyer
6,758,656 B2 7/2004 Maier et al.
7,290,995 B2 11/2007 Ohnishi et al.
7,534,193 B2 5/2009 Baxter, Jr. et al.
7,618,247 B1 11/2009 Niemiec
7,670,122 B2 3/2010 Phillips et al.
8,348,645 B2 1/2013 Kurylowski et al.
8,485,802 B2 7/2013 Bachmann et al.
8,535,030 B2 9/2013 Chua
8,668,480 B2 3/2014 Dennis et al.
(Continued)

FOREIGN PATENT DOCUMENTS

DE 102015115587 A1 3/2017
EP 0845080 B1 11/2000

OTHER PUBLICATIONS

Search Report issued in European Patent Application No. 23152714.4; Application Filing Date Jan. 20, 2023; dated Jun. 16, 2023 (10 pages).

*Primary Examiner* — Mary Davis
(74) *Attorney, Agent, or Firm* — CANTOR COLBURN LLP

(57) ABSTRACT

A stacked gerotor pump is provided. The stacked gerotor pump includes a first gerotor pump defining a first inlet section and a first outlet section, a second gerotor pump defining a second inlet section and a second outlet section and a plate. The plate is interposed between the first and second gerotor pumps and defines upstream cavities respectively communicative with the first and second inlet sections, downstream cavities respectively communicative with the first and second outlet sections and a pre-pressurization hole by which the second outlet section is communicative with the first inlet section.

20 Claims, 2 Drawing Sheets

(56) References Cited

U.S. PATENT DOCUMENTS

| | | | |
|---|---|---|---|
| 9,217,430 | B2 | 12/2015 | Smith et al. |
| 9,546,728 | B2 | 1/2017 | Schultz et al. |
| 9,920,666 | B2 | 3/2018 | Moetakef et al. |
| 10,024,318 | B2 | 7/2018 | Sakai et al. |
| 10,385,850 | B2 | 8/2019 | Pawlik |
| 10,731,701 | B2 | 8/2020 | Goy et al. |
| 10,890,181 | B2 | 1/2021 | Rosenbarger |
| 2005/0191186 | A1 | 9/2005 | Harris et al. |
| 2015/0071795 | A1 | 3/2015 | Vazquez et al. |
| 2015/0118087 | A1 | 4/2015 | Oda |
| 2016/0123323 | A1 | 5/2016 | Naiki et al. |
| 2017/0183948 | A1 | 6/2017 | Xiao et al. |
| 2021/0095566 | A1 | 4/2021 | Higashioka et al. |
| 2021/0355942 | A1 | 11/2021 | Williamson |

* cited by examiner

STACKED GEROTOR PUMP PRESSURE PULSATION REDUCTION

BACKGROUND

The present disclosure relates to gerotor pumps and, in particular, to a stacked gerotor pump for pump pressure pulsation reduction.

A generated rotor or "gerotor" is a positive displacement pump and includes an inner rotor and an outer rotor. The inner rotor has n teeth, while the outer rotor has n+1 teeth sockets (with n defined as a natural number greater than or equal to 2). An axis of the inner rotor is offset from the axis of the outer rotor and both rotors rotate on their respective axes. The geometry of the two rotors partitions the volume between them into n different dynamically-changing volumes. During the assembly's rotation cycle, each of these volumes changes continuously, so any given volume first increases, and then decreases. An increase creates a vacuum. This vacuum creates suction, and hence, this part of the cycle is where the inlet is located. As a volume decreases, compression occurs whereby fluids can be pumped, or, if they are gaseous fluids, compressed.

BRIEF DESCRIPTION

According to an aspect of the disclosure, a stacked gerotor pump is provided. The stacked gerotor pump includes a first gerotor pump defining a first inlet section and a first outlet section, a second gerotor pump defining a second inlet section and a second outlet section and a plate. The plate is interposed between the first and second gerotor pumps and defines upstream cavities respectively communicative with the first and second inlet sections, downstream cavities respectively communicative with the first and second outlet sections and a pre-pressurization hole by which the second outlet section is communicative with the first inlet section.

In accordance with additional or alternative embodiments, the first gerotor pump compresses fluid in the first inlet section and discharges compressed fluid from the first outlet section and the second gerotor pump compresses fluid in the second inlet section and discharges compressed fluid from the second outlet section.

In accordance with additional or alternative embodiments, the compressed fluid of the second outlet section is communicated to the first inlet section via the pre-pressurization hole.

In accordance with additional or alternative embodiments, the second gerotor pump is at least slightly off-phase from the first gerotor pump.

In accordance with additional or alternative embodiments, the first and second gerotor pumps each include an inner rotor having an inner rotor axis and n teeth and being rotatable on the inner rotor axis, an outer rotor having an outer rotor axis, which is offset from the inner rotor axis, and n+1 teeth sockets and being rotatable on the outer rotor axis and an outer ring that surrounds the inner rotor and the outer rotor.

In accordance with additional or alternative embodiments, n is defined as a natural number greater than or equal to 2.

In accordance with additional or alternative embodiments, n is six.

In accordance with additional or alternative embodiments, the plate includes a first baffle separating the upstream cavities and a second baffle separating the downstream cavities.

In accordance with additional or alternative embodiments, each opposed circumferential face of each of the upstream cavities and each of the downstream cavities includes an inboard inward curvature and an outboard outward curvature.

According to an aspect of the disclosure, a stacked gerotor pump is provided and includes multiple gerotor assemblies and each of the multiple gerotor assemblies includes a first gerotor pump defining a first inlet section and a first outlet section, a second gerotor pump defining a second inlet section and a second outlet section and a plate interposed between the first and second gerotor pumps and defining upstream cavities respectively communicative with the first and second inlet sections, downstream cavities respectively communicative with the first and second outlet sections and a pre-pressurization hole by which the second outlet section is communicative with the first inlet section.

In accordance with additional or alternative embodiments, the first gerotor pump compresses fluid in the first inlet section and discharges compressed fluid from the first outlet section and the second gerotor pump compresses fluid in the second inlet section and discharges compressed fluid from the second outlet section.

In accordance with additional or alternative embodiments, the compressed fluid of the second outlet section is communicated to the first inlet section via the pre-pressurization hole.

In accordance with additional or alternative embodiments, the second gerotor pump is at least slightly off-phase from the first gerotor pump.

In accordance with additional or alternative embodiments, the first and second gerotor pumps each includes an inner rotor having an inner rotor axis and n teeth and being rotatable on the inner rotor axis, an outer rotor having an outer rotor axis, which is offset from the inner rotor axis, and n+1 teeth sockets and being rotatable on the outer rotor axis and an outer ring that surrounds the inner rotor and the outer rotor.

In accordance with additional or alternative embodiments, n is defined as a natural number greater than or equal to 2.

In accordance with additional or alternative embodiments, n is six.

In accordance with additional or alternative embodiments, the plate includes a first baffle separating the upstream cavities and a second baffle separating the downstream cavities.

In accordance with additional or alternative embodiments, each opposed circumferential face of each of the upstream cavities and each of the downstream cavities includes an inboard inward curvature and an outboard outward curvature.

In accordance with additional or alternative embodiments, the stacked gerotor pump further includes first and second end gerotor assemblies, each of the first and second end gerotor assemblies including a gerotor pump defining an inlet section and an outlet section and an end plate adjacent to the gerotor pump and defining an upstream cavity communicative with the inlet section and a downstream cavity communicative with the outlet section.

According to an aspect of the disclosure, a stacked gerotor pump is provided and includes multiple gerotor assemblies and end plates. Each of the multiple gerotor assemblies includes a first gerotor pump defining a first inlet section and a first outlet section, a second gerotor pump defining a second inlet section and a second outlet section and a plate. The plate is interposed between the first and second gerotor pumps and defines upstream cavities respectively communicative with the first and second inlet sections, downstream cavities respectively communicative with the first and second outlet sections and a pre-pressurization hole by which the second outlet section is communicative with the first inlet section. The end plates are adjacent to exterior ones of the first and second gerotor pumps and respectively define an upstream cavity communicative with the corresponding first or second inlet section and a downstream cavity communicative with the corresponding first or second outlet section.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Gerotors tend to cause discharge pressure ripples due to high air content in the fluid being pumped. More particularly, in a gerotor with an inner rotor and an outer rotor, the inner rotor is connected to an input shaft that spins and exerts a load on the outer rotor which also spins. As the gerotor thus comes into and out of its mesh condition, the gerotor discharges fluid discontinuously. The magnitude of the pressure signal's peak and the valley is the pressure ripple. Pre-pressurization has been proposed to reduce such pressure ripples in applications of gerotors.

Gerotors are commonly used as lube and scavenge pumps in aerospace applications. In these or other cases, gerotors tend to suffer from pressure ripple issues.

As will be described below, a stacked gerotor pump is provided and is formed to define pre-pressurization holes to reduce pressure pulsations.

Figure 1:
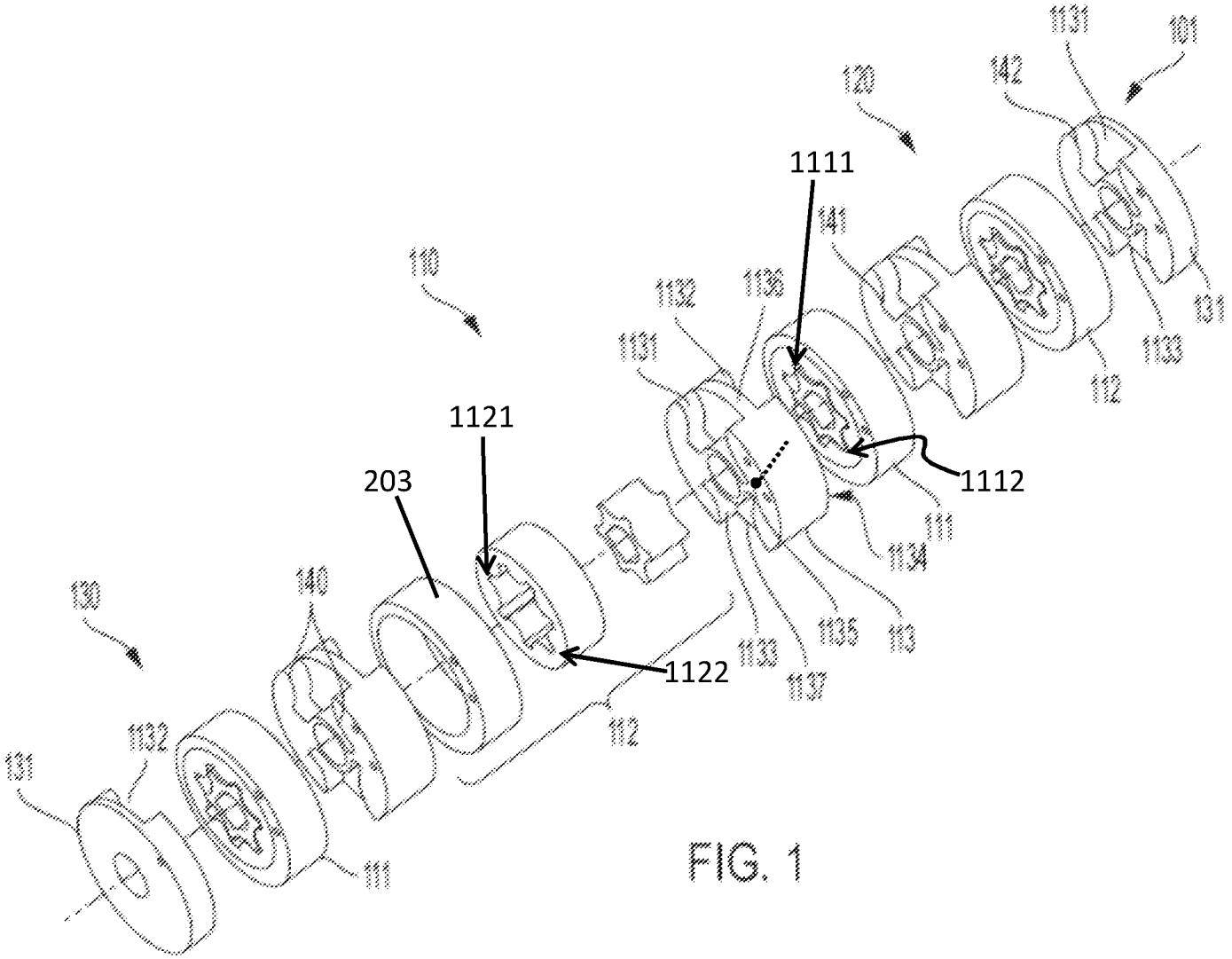
FIG. 1 is a perspective view of a stacked gerotor pump in accordance with embodiments.
Figure 2:
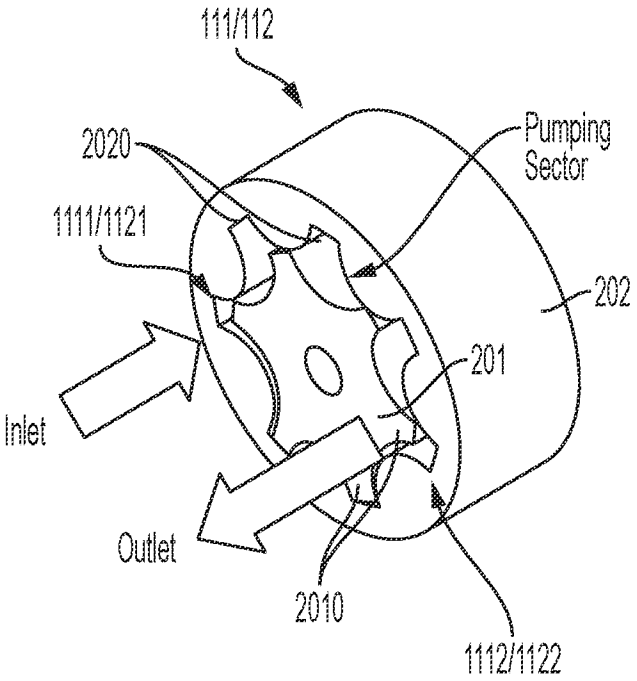
FIG. 2 is an enlarged perspective view of a gerotor pump of the stacked gerotor pump of FIG. 1 in accordance with embodiments.

With reference to FIGS. 1 and 2, a stacked gerotor pump 101 is provided and includes two or more gerotor assemblies 110, a first end gerotor assembly 120 at a first end of the stack and a second end gerotor assembly 130 at a second end of the stack opposite the first end of the stack. Each of the multiple gerotor assemblies 110 includes a first gerotor pump 111, a second gerotor pump 112 and a plate 113. The first gerotor pump 111 is formed to define a first inlet section 1111 (see FIG. 2), in which fluid is compressed, and a first outlet section 1112 (see FIG. 2), from which compresses fluid is discharged. The first gerotor pump 111 can be operable in a first phase. The second gerotor pump 112 is formed to define a second inlet section 1121 (see FIG. 2), in which fluid is compressed, and a second outlet section 1122 (see FIG. 2), from which compressed fluid is discharged. The second gerotor pump 112 can be operable in a second phase. The second phase can be in-phase with the first phase, can be slightly off-phase from the first phase or can be substantially off-phase from the first phase. The plate 113 is formed to define upstream cavities 1131 and 1132, downstream cavities 1133 and 1134 (hidden) and a pre-pressurization hole 1135. The plate 113 includes a first baffle 1136, which separates the upstream cavities 1131 and 1132 from one another, and a second baffle 1137, which separates the downstream cavities 1133 and 1134 from one another.

Upstream cavity 1131 is fluidly communicative with the first inlet section 1111 and upstream cavity 1132 is fluidly communicative with the second inlet section 1121. The first baffle 1136 isolates the upstream cavity 1131 and the first inlet section 1111 from the upstream cavity 1132 and the second inlet section 1121. Downstream cavity 1133 is fluidly communicative with the first outlet section 1112 and downstream cavity 1134 is fluidly communicative with the second outlet section 1122. The second baffle 1137 isolates the downstream cavity 1133 and the first outlet section 1112 from the downstream cavity 1134 and the second outlet section 1122. The pre-pressurization hole 1135 allows the second outlet section 1122 to be fluidly communicative with the first inlet section 1111. As such, the compressed fluid of the second outlet section 1122 is communicated to the first inlet section 1111 via the pre-pressurization hole 1135.

With the compressed fluid of the second outlet section 1122 being communicated to the first inlet section 1111 via the pre-pressurization hole 1135, a pressure of the fluid being discharged from the second outlet section 1122 by way of the downstream cavity 1134 can be reduced. This in turn reduces a magnitude of the pressure ripple.

Due to the reduced magnitude of the pressure ripple, downstream components that are receptive of pressurized fluids from the stacked gerotor pump 101 can be re-sized accordingly. That is, in a conventional lube and scavenge pump system in which pressure ripple magnitudes are high, downstream components need to be sufficiently large to withstand and absorb the effects of the high-magnitude pressure ripples. By contrast, in a lube and scavenge pump system using the stacked gerotor pump 101, pressure ripple magnitudes are reduced and downstream components can be downsized accordingly.

In accordance with embodiments, the downstream components can be any components requiring lubrication. These can include, but are not limited to, gears, motors/generators and clutches/starters.

With reference to FIG. 2, the first and second gerotor pumps 111 and 112 can each include an inner rotor 201 having an inner rotor axis and n teeth 2010 and being rotatable on the inner rotor axis, an outer rotor 202 having an outer rotor axis and an outer ring 203. The outer rotor 202 is offset from the inner rotor axis and has n+1 teeth sockets 2020. The inner rotor 201 is rotatable about the inner rotor axis within an aperture within the outer rotor 202 such that the teeth 2010 of the inner rotor 201 engage sequentially with the n+1 teeth sockets 2020 of the outer rotor 202. The aperture of the outer rotor 202 can be scalloped to form the n+1 teeth sockets 2020. The outer rotor 202 is rotatable on the outer rotor axis. The outer ring 203 surrounds the inner rotor 201 and the outer rotor 202. In accordance with embodiments, n can be defined as a natural number greater than or equal to 2 (e.g., six). With this construction, as shown in FIG. 2, the interaction of the n teeth 2010 of the inner rotor 201 and the n+1 teeth sockets 2020 of the outer rotor 202 forms an inlet (i.e., the first or second inlet section 1111 or 1121) and an outlet (i.e., the first or second outlet section 1112 or 1122).

With reference back to FIG. 1, the upstream cavities 1131 and 1132 and the downstream cavities 1133 and 1134 generally taper outwardly with increasing radial distance from a central axis. In addition, as shown in FIG. 1, each opposed circumferential face 140 of each of the upstream cavities 1131 and 1132 and each of the downstream cavities 1133 and 1134 includes an inboard inward curvature 141 and an outboard outward curvature 142.

With continued reference to FIG. 1, the first end gerotor assembly 120 and the second end gerotor assembly 130 each include a first or second gerotor pump 111 or 112 as described above and an end plate 131 adjacent to the first or second gerotor pump 111 or 112. The end plate 131 defines an upstream cavity 1131 or 1132 that is fluidly communicative with the corresponding first or second inlet section 1111 or 1121 and a downstream cavity 1133 or 1134 that is fluidly communicative with the corresponding first or second outlet section 1112 or 1122 similarly as described above.

Technical effects and benefits of the present disclosure are the provision of a gerotor pump that exhibits reduced pressure pulsations in a lubrication system that results in longer system component life, reduced cavitation damage and improved system performance.

The corresponding structures, materials, acts, and equivalents of all means or step-plus function elements in the claims below are intended to include any structure, material, or act for performing the function in combination with other claimed elements as specifically claimed. The description of the present disclosure has been presented for purposes of illustration and description, but is not intended to be exhaustive or limited to the technical concepts in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A stacked gerotor pump, comprising:

a first gerotor pump defining a first inlet section and a first outlet section;

a second gerotor pump defining a second inlet section and a second outlet section; and a plate interposed between the first and second gerotor pumps and defining upstream cavities respectively communicative with the first and second inlet sections, downstream cavities respectively communicative with the first and second outlet sections and a pre-pressurization hole by which the second outlet section is communicative with the first inlet section.

2. The stacked gerotor pump according to claim 1, wherein:

the first gerotor pump compresses fluid in the first inlet section and discharges compressed fluid from the first outlet section, and the second gerotor pump compresses fluid in the second inlet section and discharges compressed fluid from the second outlet section.

3. The stacked gerotor pump according to claim 2, wherein the compressed fluid of the second outlet section is communicated to the first inlet section via the pre-pressurization hole.

4. The stacked gerotor pump according to claim 2, wherein the second gerotor pump is off-phase from the first gerotor pump.

5. The stacked gerotor pump according to claim 1, wherein the first and second gerotor pumps each comprise:

an inner rotor having an inner rotor axis and n teeth and being rotatable on the inner rotor axis;

an outer rotor having an outer rotor axis, which is offset from the inner rotor axis, and n+1 teeth sockets and being rotatable on the outer rotor axis; and an outer ring that surrounds the inner rotor and the outer rotor.

6. The stacked gerotor pump according to claim 5, wherein n is defined as a natural number greater than or equal to 2.

7. The stacked gerotor pump according to claim 5, wherein n is six.

8. The stacked gerotor pump according to claim 1, wherein the plate comprises:

a first baffle separating the upstream cavities; and a second baffle separating the downstream cavities.

9. The stacked gerotor pump according to claim 8, wherein each opposed circumferential face of each of the upstream cavities and each of the downstream cavities comprises:

an inboard inward curvature; and an outboard outward curvature.

10. A stacked gerotor pump, comprising:

multiple gerotor assemblies, each of the multiple gerotor assemblies comprising:

a first gerotor pump defining a first inlet section and a first outlet section;

a second gerotor pump defining a second inlet section and a second outlet section; and a plate interposed between the first and second gerotor pumps and defining upstream cavities respectively communicative with the first and second inlet sections, downstream cavities respectively communicative with the first and second outlet sections and a pre-pressurization hole by which the second outlet section is communicative with the first inlet section.

11. The stacked gerotor pump according to claim 10, wherein:

the first gerotor pump compresses fluid in the first inlet section and discharges compressed fluid from the first outlet section, and the second gerotor pump compresses fluid in the second inlet section and discharges compressed fluid from the second outlet section.

12. The stacked gerotor pump according to claim 11, wherein the compressed fluid of the second outlet section is communicated to the first inlet section via the pre-pressurization hole.

13. The stacked gerotor pump according to claim 11, wherein the second gerotor pump is off-phase from the first gerotor pump.

14. The stacked gerotor pump according to claim 10, wherein the first and second gerotor pumps each comprise:

an inner rotor having an inner rotor axis and n teeth and being rotatable on the inner rotor axis;

an outer rotor having an outer rotor axis, which is offset from the inner rotor axis, and n+1 teeth sockets and being rotatable on the outer rotor axis; and an outer ring that surrounds the inner rotor and the outer rotor.

15. The stacked gerotor pump according to claim 14, wherein n is defined as a natural number greater than or equal to 2.

16. The stacked gerotor pump according to claim 14, wherein n is six.

17. The stacked gerotor pump according to claim 10, wherein the plate comprises:

a first baffle separating the upstream cavities; and a second baffle separating the downstream cavities.

18. The stacked gerotor pump according to claim 17, wherein each opposed circumferential face of each of the upstream cavities and each of the downstream cavities comprises:

an inboard inward curvature; and an outboard outward curvature.

19. The stacked gerotor pump according to claim 10, further comprising first and second end gerotor assemblies, each of the first and second end gerotor assemblies comprising:

an end gerotor pump defining an end inlet section and an end outlet section; and an end plate adjacent to the end gerotor pump and defining an upstream cavity communicative with the end inlet section and a downstream cavity communicative with the end outlet section.

20. A stacked gerotor pump, comprising:

multiple gerotor assemblies, each of the multiple gerotor assemblies comprising:

a first gerotor pump defining a first inlet section and a first outlet section;

a second gerotor pump defining a second inlet section and a second outlet section; and a plate interposed between the first and second gerotor pumps and defining upstream cavities respectively communicative with the first and second inlet sections, downstream cavities respectively communicative with the first and second outlet sections and a pre-pressurization hole by which the second outlet section is communicative with the first inlet section; and end plates adjacent to exterior ones of the first and second gerotor pumps and respectively defining an upstream cavity communicative with the corresponding first or second inlet section and a downstream cavity communicative with the corresponding first or second outlet section.

* * * * *